US005332387A

United States Patent [19]

Sheng

[11] Patent Number: 5,332,387

[45] Date of Patent: Jul. 26, 1994

[54] CIGARETTE LIGHTER

[76] Inventor: Andy W. Sheng, 16429 Berwyn St., Cerritos, Calif. 90701

[21] Appl. No.: 112,888

[22] Filed: Aug. 27, 1993

[51] Int. Cl.[5] ..... F23D 11/36

[52] U.S. Cl. ..... 431/153; 431/131; 431/254; 431/255

[58] Field of Search ..... 431/153, 156, 277, 254, 431/256, 130–135

[56] References Cited

U.S. PATENT DOCUMENTS

| | | | |
|---|---|---|---|
| 4,036,579 | 7/1977 | Marynissen | 431/131 |
| 5,090,893 | 2/1992 | Floriot | 431/254 X |
| 5,125,829 | 6/1992 | McDonough et al. | 431/255 |
| 5,213,493 | 5/1993 | Iwahori | 431/153 |

*Primary Examiner*—Larry Jones
*Attorney, Agent, or Firm*—Sheldon & Mak

[57] ABSTRACT

Disclosed is a cigarette lighter including a tank for a pressurized combustible gas; a normally closed feed valve having a nozzle outlet, the valve being connected to the tank for preventing exit of the gas from the tank and being openable in response to external force for feeding the gas for combustion thereof; a base fixedly supported relative to the valve; an actuator movably supported relative to the base for opening the valve, the actuator transmitting the external force when opening the valve, the gas being ignited when fed from the tank when the valve is engaged and opened by the actuator; and a safety device movable and operable from a normal position for holding the actuator disengaged from the valve to a released position for enabling the actuator to engage and open the valve. The safety device includes a body rotatably supported relative to the base between first and second angular positions, an engagement portion shifting the actuator between a first path in the released position of the safety device for actuating the valve in the first angular position, and a second path in the normal position of the safety device in the second angular position. A handle moves the body to the second angular position. The safety device is automatically returned to the normal position whereby the actuator is prevented from engaging the valve after use of the lighter.

8 Claims, 3 Drawing Sheets

CIGARETTE LIGHTER

BACKGROUND

The present invention relates to a cigarette lighters and in particular to a cigarette lighters having safety features for preventing accidental operation, particularly by young children.

Cigarette lighters of the prior art include those having safety devices which prevent the accidental operation of the lighter unless the safety device is released. A typical safety device of the prior art prevents downward movement of a valve actuator of the lighter, the valve actuator remaining in contact with a fuel valve of the lighter. However, the safety devices of many such lighters do not automatically reset after the lighter has been operated. Some recently developed lighters have a so-called "self-retrieving" safety mechanism. However, such lighters are not wholly satisfactory since they are often awkward to operate, and the safety mechanisms are often not fully effective, particularly in that the valve actuator remains in contact with the fuel valve.

Thus there is a need for a cigarette lighter having a "self-retrieving" safety mechanism that is easy to operate by intended users, is inexpensive to provide, and which can reliably prevent unintentional and unauthorized use of the lighter, especially by young children.

SUMMARY

The present invention meets this need by providing a safety interlocked cigarette lighter having a tank for a combustible fluid; a normally closed feed valve connected to the tank for preventing exit of the combustible fluid from the tank, the feed valve being openable in response to external force for feeding the fluid for combustion thereof; a base fixedly supported relative to the valve; a valve actuator movably supported relative to the base for opening the valve, the actuator transmitting the external force when opening the valve; ignition means for igniting fluid being fed from the tank when the valve is engaged and opened by the valve actuator; a safety device movably supported relative to the base and operable from a normal position for holding the valve actuator disengaged from the valve to a released position for enabling the valve actuator to engage and open the valve; and biasing means for automatically returning the safety device to the normal position whereby the valve actuator is prevented from engaging the valve after use of the cigarette lighter.

The combustible fluid can be gas under pressure. The gas can be butane. The lighter preferably includes a nozzle for releasing the fluid from the valve, the ignition means producing a spark in the vicinity of the nozzle. The actuator can be movable in a first path relative to the base in response to the external force in the released position of the safety device for actuating the valve and in a second path in the normal position of the safety device, at least a portion of the second path being laterally shifted relative to the first path whereby movement of the actuator in response to the external force does not produce contact with the valve.

The safety device can include a body member rotatably supported relative to the base between first and second angular positions and having an eccentrically formed engagement portion for laterally shifting the actuator for movement thereof between the first and second paths in response to rotation of the body member, whereby the body member is in the first angular position in the normal position of the safety device and the second angular position in the released position; a radially projecting safety handle for moving the body member to the second angular position, the biasing means being connected between the base and the body member for rotatably urging the body member to the first angular position.

The safety mechanism of the present invention differs from known mechanisms in that it disconnects the valve actuator from the valve rather than simply preventing the downward movement of the valve actuator which still remains in contact with the valve.

A particularly preferred embodiment of the safety device provides that once a flame has been generated, the action of the biasing means returns the safety device to its locking position which "locks" the action of the valve actuator, so it cannot engage and open the valve, i.e., a so-called "self-retrieving" action. To use the cigarette lighter again, the safety device must be released by being moved against the action of the biasing means to a position whereby the valve actuator engages and opens the valve and gas can be released and ignited. Such an action is difficult for a young child and it also prevents accidental operation of the cigarette lighter by its being caught on clothing, etc. More particularly, the body member can be axially movable relative to the base in the second angular position from a normal position to a cocked position for preventing movement thereof by the biasing means to the first angular position, the safety device including a trigger for automatically returning the body member to the normal position from the cocked position upon activation of the valve by the actuator. The engagement portion of the body member can project into a cavity of the actuator, the trigger including an axial extremity of the engagement portion, the axial extremity being contacted by an end portion of the cavity in response to the external force during activation of the valve for axial movement of the body member.

DRAWINGS

These and other features, aspects, and advantages of the present invention will become better understood with reference to the following description, appended claims, and accompanying drawings, where:

Figure 1:
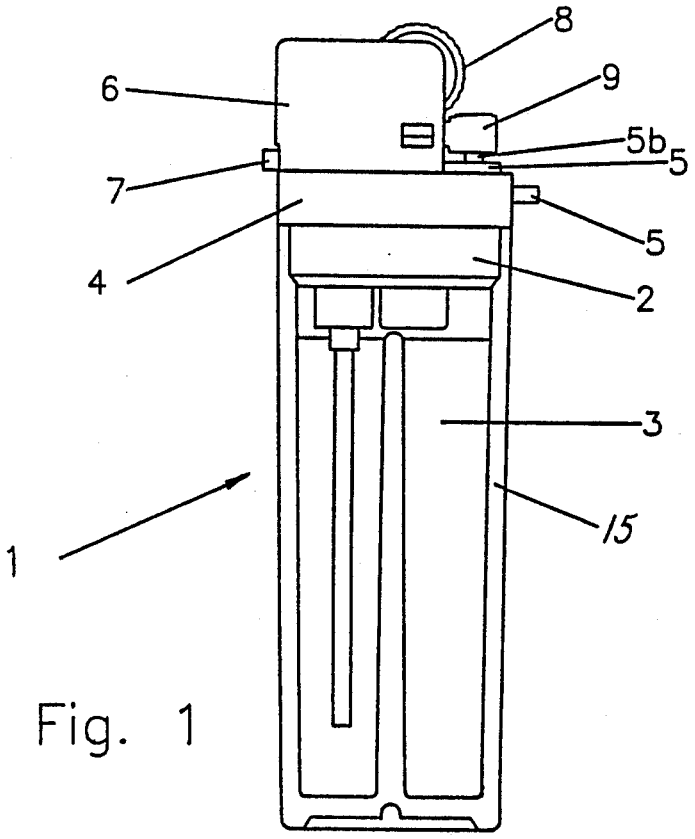
FIG. 1 is a side elevational view of a cigarette lighter having a safety device according to the present invention.
Figure 6A:
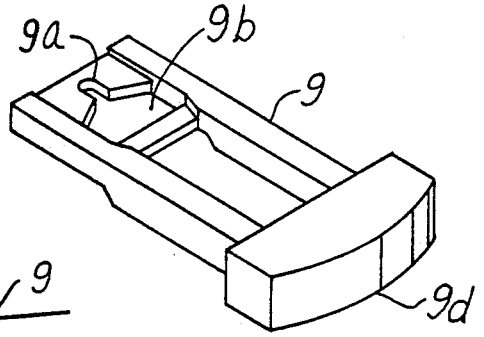
Figure 6B:
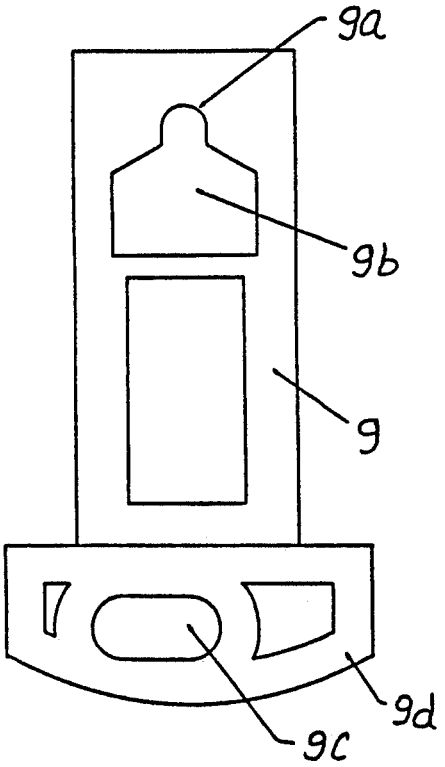

FIG. 6*a* is an upper oblique elevational perspective view of a valve actuator portion of the lighter of FIG. 1;

FIG. 6*b* is a bottom plan view of the valve actuator portion of FIG. 6*a;*

Figure 7:
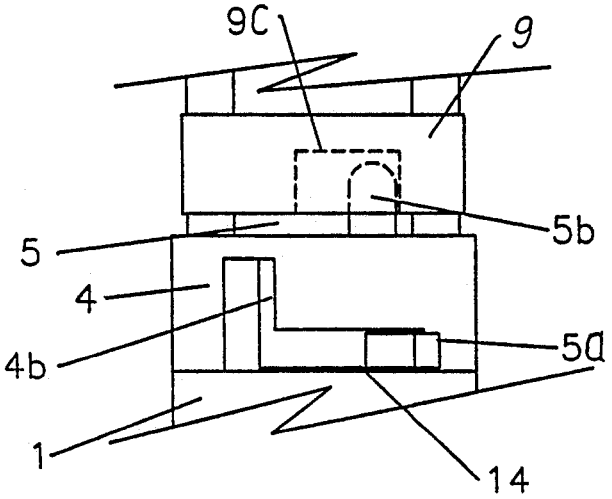
Figure 8:
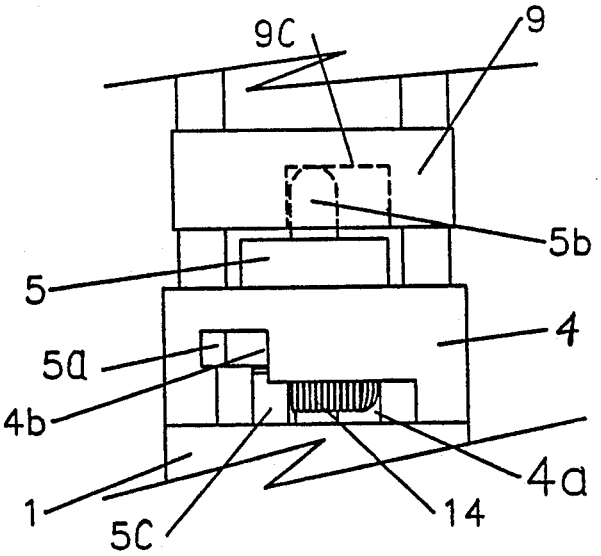

FIG. 7 is a front elevational view of the cigarette lighter of FIG. 1 with the safety device in the locked position; and FIG. 8 is a front elevational view as in FIG. 7 showing the safety device released.

DESCRIPTION

Figure 2:
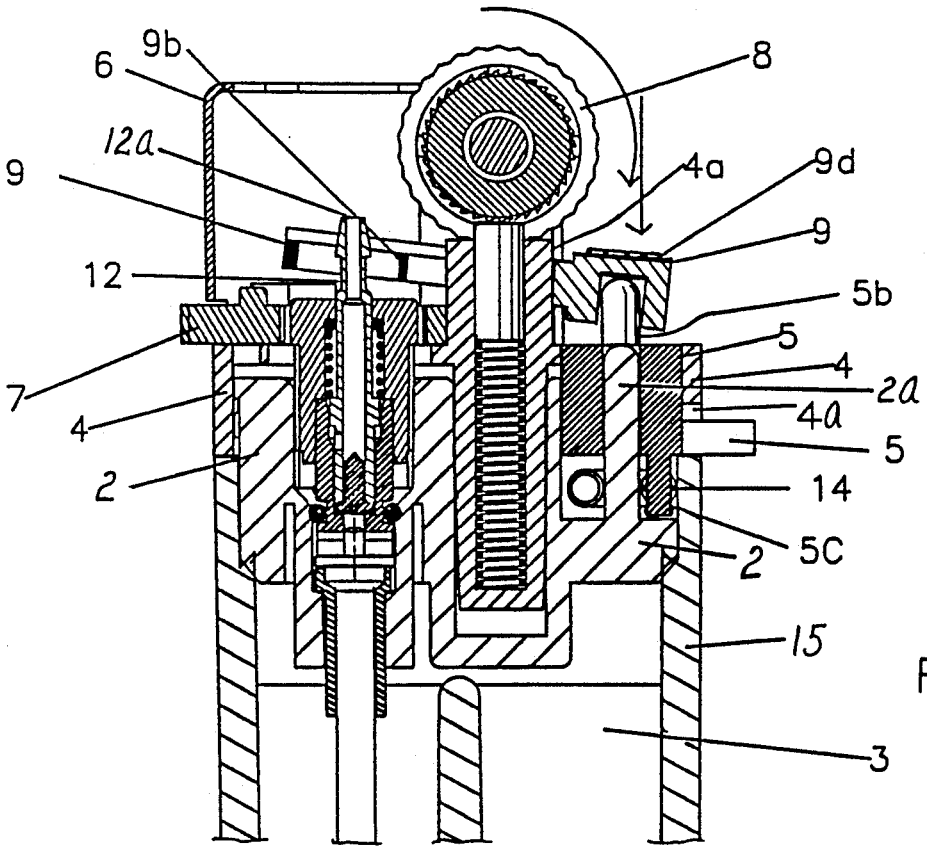
FIG. 2 is a sectional elevational detail view of the cigarette lighter of FIG. 1 with the safety device in a normally locked position.
Figure 3:
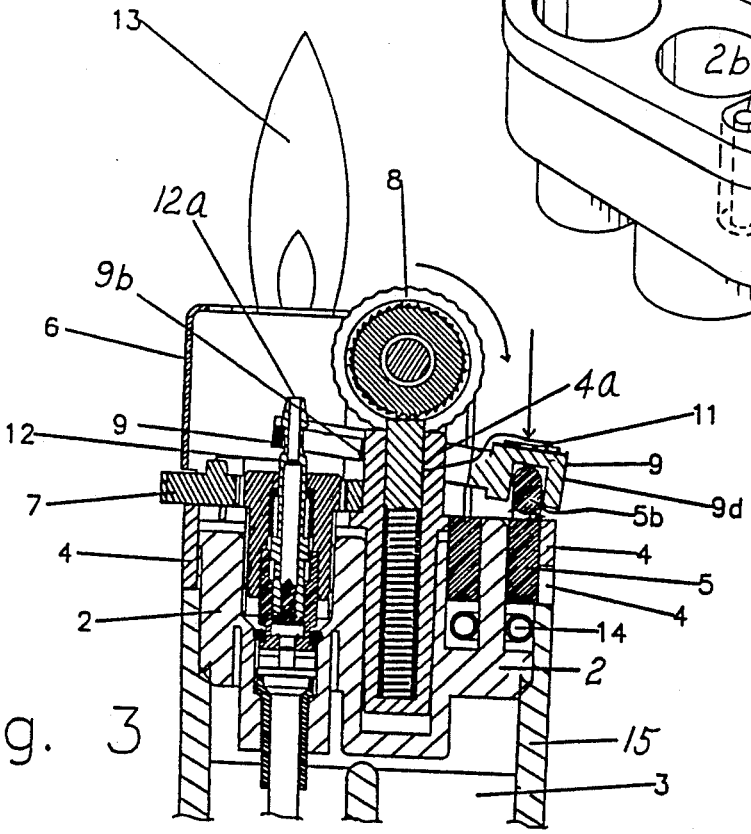
FIG. 3 is a vertical section through the cigarette lighter of FIG. 1 with the safety device released.

The present invention is directed to a cigarette lighter having a "self-retrieving" safety mechanism that is inexpensive and easy to use, and is effective for preventing unintentional activation and unauthorized activation by young children. With reference to FIGS. 1–8 of the drawings, the cigarette lighter of the present invention designated generally as 1 includes a tank 15 for a combustible fuel or gas 3. The tank 15 is sealingly closed by an inwardly projecting tank cover 2 as shown in FIG. 2, a collar 4 surrounding the tank cover 2 and contacting an upper extremity of the tank 15. An upwardly projecting metal cap or windshield 6 is located on the collar 4 and acts for preventing a flame 13 from being extinguished when the cigarette lighter 1 is operated. Also shown in FIG. 1 is a body member of the safety device, designated 5, a valve actuator 9, a spark producing wheel 8 and lever 7 which operates a conventional mechanism for adjusting the height of the flame 13. Depression of a finger plate 9*d* of the valve actuator 9 causes activation of a valve 12 by upward movement thereof in response to rocking of the actuator 9 relative to the tank cover 2 when the safety device 5 is released as shown in FIG. 3 for permitting fuel to flow through the valve 12 to be ignited by sparks produced by the wheel 8 engaging a flint 11.

The body member of the safety device 5 is rotatably supported on an upstanding shaft 2*a* that forms a part of the tank cover 2. An upwardly projecting crank pin 5*b* is formed on the body member 5, eccentrically located relative to the shaft 2*a*, the pin 5*b* extending into engagement with a cavity slot 9*c* of the valve actuator 9 for lateral movement thereof in response to rotation of the body member 5 on the shaft 2*a*. When the body member 5 is in its locking position as shown in FIG. 2, the valve actuator 9 is disengaged from the valve 12 so that depression of the finger plate 9*d* and rocking of the valve actuator 9 by an external force as indicated by the downwardly directed arrow in FIG. 2 cannot open the valve 12, thereby preventing both flow of the gas 3 from the tank 15 and production of the flame 13.

More particularly, when the body member 5 is in its locking position as shown in FIG. 2, the valve actuator 9 is shifted from disengagement from the valve 12, the valve 12 projecting within a clearance opening 9*b* of the valve actuator 9. Contrastingly, the valve 12 engages a recess 9*a*of the valve actuator when the body member 5 is in the released position of FIG. 3, the recess 9*a* and the clearance opening 9*b* being most clearly shown in FIGS. 6*a* and 6*b*. By shifting the valve actuator 9 according to the present invention so that the valve 12 is spaced within the clearance opening 9*b* when the body member of the safety device 5 is in its locking position as shown in FIG. 2, there is no contact of the valve 12 at all in response to depression of the finger plate 9*d*, assuring that no leakage of the gas 3 can result from disturbance of the valve 12.

As further shown in FIG. 2, a spring 14 is connected for biasing the body member 5 of the safety device toward the locking position, one end of the spring 14 being attached to a leg 5*c* of the body member 5 and an opposite end of the spring 14 being attached to a peg 2*b* (shown in FIGS. 4 and 5) which forms part of the tank cover 2, the spring 14 resiliently biasing the body member of the safety device 5 to its locking position. The body member of the safety device 5 is also provided with a radially extending operating lever 5*a* that is axially guided within a horizontal slot 4*a* of the collar 4 as shown in FIG. 7, the lever 5*a* being operable for rotating the body member 5 in a direction overcoming the biasing by the spring 14 as shown in FIG. 8.

In FIG. 3, the operating lever 5*a* has been rotatably moved along the horizontal slot 4*a* and out of engagement therewith, being typically axially moved into cocking engagement with a vertical slot 4*b* that is preferably formed in the collar 4 as shown in FIG. 8, thereby causing the valve actuator 9 to move into a position whereby the valve 12 engages the recess 9*a* of the valve actuator 9 and manual depression of the finger plate 9*d* of the valve actuator 9 and simultaneous rotation of the spark wheel 8 causes the valve 12 to open, gas 3 to flow, a spark to be generated by the spark wheel 8 rubbing the flint 11 and a flame 13 to be generated at a nozzle 12*a* of the valve 12. The cocking engagement of the lever 5*a* with the vertical slot 4*b* advantageously facilitates operation of the cigarette lighter 1 by permitting the simultaneous operation of the wheel 8 and the finger plate 9*d* without requiring the body member 5 to be held in the released position of FIG. 3 against the spring 14 by the lever 5*a* at the same time. Nevertheless, the cigarette lighter 1 in the preferred form of the present invention having the vertical slot 4*b* is effective against inadvertent operation and against unauthorized operation by small children because the body member 5 will normally be returned to the locking position of FIG. 2 even if the lever 5*a* is momentarily moved out of engagement with the horizontal slot 4*a*. More particularly, a small child would likely be incapable of moving the lever 5*a* from the horizontal slot 4*a*, and would further likely not be either able or inclined to then move the lever 5*a* upwardly onto the vertical slot 4*b*.

As the finger plate 9*d* of the valve actuator 9 is depressed, the body member of the safety device 5 is axially displaced by contact between an end extremity of the crank pin 5*b* and an upper extremity of the cavity slot 9*c* so that the lever 5*a* is triggered or driven from engagement with the vertical slot 4*b*, whereupon the body member 5 moves back to its locking position (as shown in FIG. 2) under the action of the spring 14).

Figure 5:
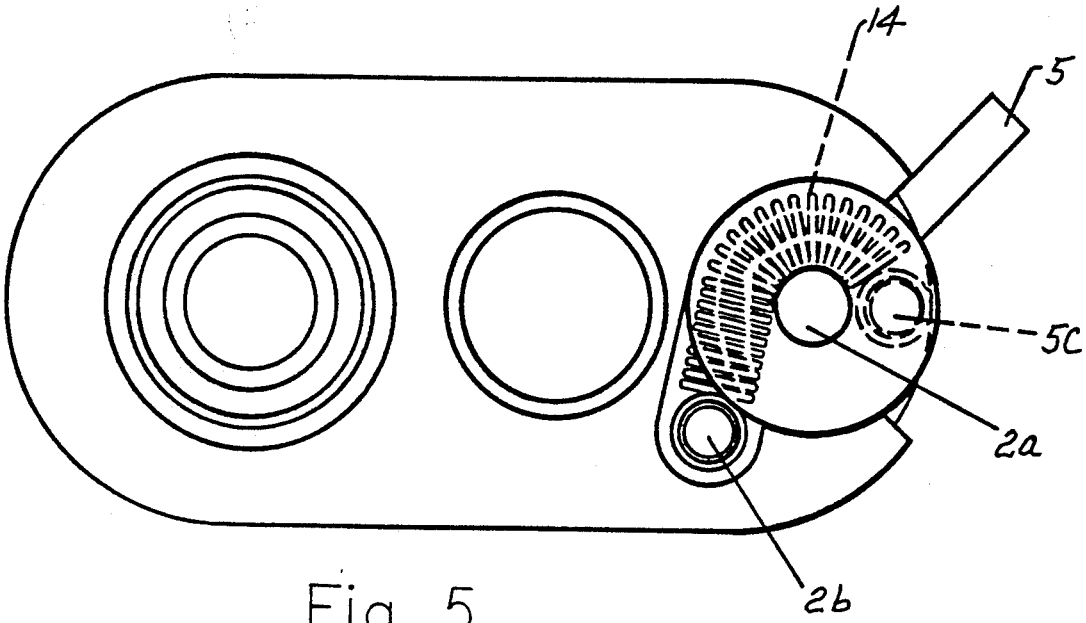
FIG. 5 is a plan view of the lighter portion of FIG. 4.
Figure 4:
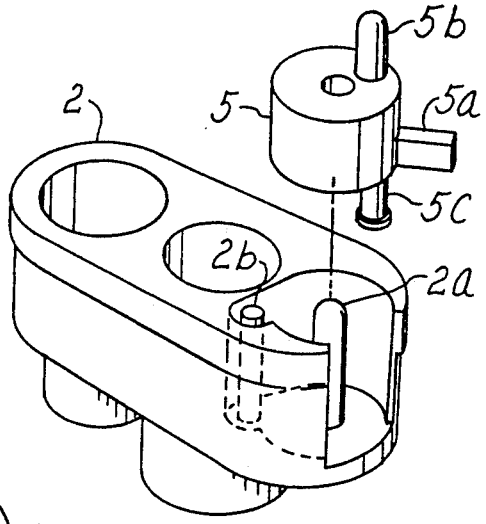
FIG. 4 is a semi-exploded oblique elevational perspective view of a portion of the cigarette lighter of FIG. 1; .

The body member of the safety device 5 and the tank cover 2 are shown most clearly in FIGS. 4 and 5, the body member 5 being generally cylindrical with the crank pin 5*b* which locates in the cavity slot 9*c* of the valve actuator 9 upwardly projecting in offset relation to the supporting shaft 2*a*, the leg 5*c* to which is attached an end of the spring 14 similarly downwardly projecting in spaced relation to the shaft 2*a*. The operating lever 5*a* radially projects through the slot 4*a*/4*b* beyond the collar 4 for user manipulation thereof. Further shown in FIGS. 4 and 5 are the upstanding peg 2*b* of the tank cover 2 and, as shown in FIG. 5, one end of the spring 14 attached to the leg 5*c* of the body member 5 and the other end of the spring 14 attached to the peg 2*b* of the tank cover 2, a portion of the spring 14 being wrapped in tension about the body member 5.

The valve actuator 9, shown most clearly in FIGS. 6*a* and 6*b* as described above, has the cavity slot 9*c* formed blind on the underside of the finger plate 9*d* for receiving the guide pin 5*b* of the body member 5, the clearance opening 9*b* which receives the valve 12 when the safety device 5 is in the normal locking position being located adjacent the recess 9*a* that engages the valve 12 when the body member 5 of the safety device is released. When the safety device is released, the guide pin 5*b* travels along the cavity slot 9*c* as the body member 5 is rotated by the lever 9a, so causing the valve actuator 9 to move horizontally, so causing the valve 12 to be engaged within the recess 9a.

In FIG. 7, the body member of the safety device 5 is shown in its locking position preventing operation of the cigarette lighter 1 as described above, the lever 5a being held at the right extremity of the slot 4a under the action of the spring 14 and the pin 5bengaging a right portion of the cavity slot 9c of the valve actuator 9. In FIG. 8, the safety device 5 is shown in its released position wherein the cigarette lighter 1 is operable. The lever 5a has been moved against the action of the spring 14 along the slot 4a and into the slot 4b. At the same time, the pin 5b has moved to the left within the cavity slot 9c of the valve actuator 9 as the valve actuator 9 has shifted to engage the valve 12 within the recess 9a.

Although the present invention has been described in considerable detail with reference to certain preferred versions thereof, other versions are possible. For example, ignition of the flame 13 can be by electronic means. Also, the body member 5 can be slidably supported relative to the tank cover 2, the spring 14 being a compression spring instead of a tension spring that wraps about the body member 5 as described above. Therefore, the spirit and scope of the appended claims should not necessarily be limited to the description of the preferred versions contained herein.

What is claimed is:

1. A cigarette lighter comprising:

(a) a tank for a combustible fluid;

(b) a normally closed feed valve connected to the tank for preventing exit of the combustible fluid from the tank, the feed valve being openable in response to external force for feeding the fluid for combustion thereof;

(c) a base fixedly supported relative to the valve;

(d) a valve actuator movably supported relative to the base for opening the valve, the actuator transmitting the external force when opening the valve;

(e) ignition means for igniting fluid being fed from the tank when the valve is engaged and opened by the valve actuator;

(f) a safety device movably supported relative to the base and operable from a normal position for holding the valve actuator disengaged from the valve to a released position for enabling the valve actuator to engage and open the valve, the actuator being movable in a first path relative to the base in response to the external force in the released position of the safety device for actuating the valve and in a second path in the normal position of the safety device, at least a portion of the second path being laterally shifted relative to the first path whereby movement of the actuator in response to the external force does not produce contact with the valve; and (g) biasing means for automatically returning the safety device to the normal position whereby the valve actuator is prevented from engaging the valve after use of the cigarette lighter.

2. The lighter of claim 1, wherein the combustible fluid is gas under pressure.

3. The lighter of claim 2, wherein the gas is butane.

4. The lighter of claim 1, further comprising a nozzle for releasing the fluid from the valve, the ignition means producing a spark in the vicinity of the nozzle.

5. The lighter of claim 1, wherein the safety device comprises:

(a) a body member rotatably supported relative to the base between first and second angular positions and having an eccentrically formed engagement portion for laterally shifting the actuator for movement thereof between the first and second paths in response to rotation of the body member, whereby the body member is in the first angular position in the normal position of the safety device and the second angular position in the released position;

(b) a radially projecting safety handle for moving the body member to the second angular position;

(c) the biasing means being connected between the base and the body member for rotatably urging the body member to the first angular position.

6. A cigarette lighter comprising:

(a) a tank for a combustible fluid;

(b) a normally closed feed valve connected to the tank for preventing exit of the combustible fluid from the tank, the feed valve being openable in response to external force for feeding the fluid for combustion thereof;

(c) a base fixedly supported relative to the valve;

(d) a valve actuator movably supported relative to the base for opening the valve, the actuator transmitting the external force when opening the valve;

(e) ignition means for igniting fluid being fed from the tank when the valve is engaged and opened by the valve actuator;

(f) a safety device movably supported relative to the base and operable from a normal position for holding the valve actuator disengaged from the valve to a released position for enabling the valve actuator to engage and open the valve, the safety device comprising:

(i) a body member rotatably supported relative to the base between first and second angular positions and having an eccentrically formed engagement portion for laterally shifting the actuator for movement thereof between a first path relative to the base in response to the external force in the released position of the safety device for actuating the valve, and a second path in the normal position of the safety device, at least a portion of the second path being laterally shifted relative to the first path, whereby the body member is in the first angular position in the normal position of the safety device and the second angular position in the released position, movement of the actuator in response to the external force not producing contact with the valve; and (ii) a radially projecting safety handle for moving the body member to the second angular position; the actuator being movable in a first path relative to the base in response to the external force in the released position of the safety device for actuating the valve and in a second path in the normal position of the safety device, at least a portion of the second path being laterally shifted relative to the first path whereby movement of the actuator in response to the external force does not produce contact with the valve;

(g) biasing means for automatically returning the safety device to the normal position whereby the valve actuator is prevented from engaging the valve after use of the cigarette lighter, the biasing means being connected between the base and the body member for rotatably urging the body member to the first angular position, the body member being axially movable relative to the base in the second angular position from a normal position to a cocked position for preventing movement thereof by the biasing means to the first angular position; and (h) a trigger for automatically returning the body member to the normal position from the cocked position upon activation of the valve by the actuator.

7. The lighter of claim 6, wherein the engagement portion of the body member projects into a cavity of the actuator, the trigger comprising an axial extremity of the engagement portion, the axial extremity being contacted by an end portion of the cavity in response to the external force during activation of the valve for axial movement of the body member.

8. A cigarette lighter comprising:

(a) a tank for a pressurized combustible gas;

(b) a normally closed feed valve having a nozzle outlet, the valve being connected to the tank for preventing exit of the gas from the tank, the feed valve being openable in response to external force for feeding the gas for combustion thereof;

(c) a base fixedly supported relative to the valve;

(d) a valve actuator movably supported relative to the base for opening the valve, the actuator transmitting the external force when opening the valve;

(e) ignition means for igniting gas being fed from the tank when the valve is engaged and opened by the valve actuator, the ignition means producing a spark in the vicinity of the nozzle;

(f) a safety device movably supported relative to the base and operable from a normal position for holding the valve actuator disengaged from the valve to a released position for enabling the valve actuator to engage and open the valve, the safety device comprising:

(i) a body member rotatably supported relative to the base between first and second angular positions and having an eccentrically formed engagement portion for laterally shifting the actuator for movement thereof between a first path relative to the base in response to the external force in the released position of the safety device for actuating the valve, and a second path in the normal position of the safety device, at least a portion of the second path being laterally shifted relative to the first path, whereby the body member is in the first angular position in the normal position of the safety device and the second angular position in the released position, movement of the actuator in response to the external force not producing contact with the valve; and (ii) a radially projecting safety handle for moving the body member to the second angular position;

(g) biasing means for automatically returning the safety device to the normal position whereby the valve actuator is prevented from engaging the valve after use of the cigarette lighter, the biasing means being connected between the base and the body member for rotatably urging the body member to the first angular position, the body member being axially movable relative to the base in the second angular position from a normal position to a cocked position for preventing movement thereof by the biasing means to the first angular position; and (h) a trigger for automatically returning the body member to the normal position from the cocked position upon activation of the valve by the actuator, the engagement portion of the body member projecting into a cavity of the actuator, the trigger comprising an axial extremity of the engagement portion, the axial extremity being contacted by an end portion of the cavity in response to the external force during activation of the valve for axial movement of the body member.

* * * * *